US006583710B2

(12) United States Patent
Hayashi et al.

(10) Patent No.: US 6,583,710 B2
(45) Date of Patent: Jun. 24, 2003

(54) THERMOSTAT

(75) Inventors: Toshiharu Hayashi, Nara Prefecture (JP); Masaaki Fukumoto, Nara Prefecture (JP)

(73) Assignee: Wako Electronics, Osaka (JP)

( * ) Notice: Subject to any disclaimer, the term of this patent is extended or adjusted under 35 U.S.C. 154(b) by 72 days.

(21) Appl. No.: 09/832,558

(22) Filed: Apr. 11, 2001

(65) Prior Publication Data

US 2002/0097135 A1 Jul. 25, 2002

(30) Foreign Application Priority Data

Nov. 13, 2000 (JP) ..... 2000-345715

(51) Int. Cl.[7] ..... H01H 37/54; H01H 37/04
(52) U.S. Cl. ..... 337/343; 337/380
(58) Field of Search ..... 337/303, 333, 337/343, 359, 362, 365, 380, 417; 29/622

(56) References Cited

U.S. PATENT DOCUMENTS 3,720,899 A * 3/1973 Hire et al. ..... 337/348
4,528,541 A * 7/1985 Hollweck et al. ..... 337/342
4,581,509 A * 4/1986 Sanford et al. ..... 200/302.1
4,754,252 A * 6/1988 Craig, III ..... 337/112
4,794,364 A * 12/1988 Uehara ..... 337/354
4,952,901 A * 8/1990 Chrupcala et al. ..... 337/354
5,182,538 A * 1/1993 Muller ..... 200/83 P
5,270,799 A * 12/1993 Rose ..... 337/348
5,296,834 A * 3/1994 Urban ..... 337/354
6,020,807 A * 2/2000 Givler ..... 337/141
6,078,246 A * 6/2000 Davis et al. ..... 29/622

FOREIGN PATENT DOCUMENTS

GB 2092384 A * 8/1982 ..... H01H/37/54
WO WO 9216003 A1 * 9/1992 ..... H01H/37/00

* cited by examiner

*Primary Examiner*—Anatoly Vortman
(74) *Attorney, Agent, or Firm*—Vedder Price Kaufman & Kammholz

(57) ABSTRACT

The present invention provides a thermostat which does not abrade a monitored object, even if movable, and is superior in heat-responsiveness.

The present thermostat comprises an approximately round bimetal 3, a holder 2 for holding the lower surface of said bimetal 3 and a cover member 7 for holding the upper surface of said bimetal 3, wherein said bimetal 3 recurves when it exceeds a critical temperature, and said cover member 7 has an opening 7*a* which does not hinder said cover member 7 from holding said bimetal 3, and portions projecting radially inward from said opening which hold said bimetal 3.

9 Claims, 3 Drawing Sheets

TH

THERMOSTAT

BACKGROUND OF THE INVENTION

1. Field of the Invention

The present invention relates to a thermostat which does not abrade a monitored object and is superior in heat-responsiveness.

2. Description of the Related Art

Copiers and printers have a fixing roller rolled in a heated state for fixing ink onto printing paper. In order to achieve the secured fixation, a fixing roller is in contact with printing paper. These apparatus also have a thermostat in contact with a fixing roller to prevent a fixing roller from overheating.

When, therefore, a fixing roller overheats due to a malfunction of a temperature control unit such as a thermistor, and reaches a predetermined temperature, a thermosensitive member of a thermostat recurves and interrupts the electrical power. This results in preventing the fixing roller from smoking. The contact surfaces between a thermostat and a fixing roller are coated with a resin film to avoid the latter being abraded.

The drawback of the above conventional thermostat is the additional process of coating it with a resin film in its manufacturing. Even though the coating process is added, there still remains the abrasion problem because a fixing roller is in constant contact with a thermostat. While this problem can be solved by keeping them out of contact, this solution has the critical disadvantage of the deterioration of the heat conductivity and responsiveness for avoiding overheating of a thermostat.

Copiers and printers these days are designed to start operation immediately after electricity is turned on and heat a fixing roller quickly. The above bad heat-responsiveness could cause some troubles such as smoking when a thermostat is operated.

SUMMARY OF THE INVENTION

Therefore, it is an object of the present invention to provide a thermostat which does not abrade a monitored object, even if rotatable or movable, and is superior in heat-responsiveness. To achieve the above object, the present invention comprises an approximately round thermosensitive member, a holder for holding one surface of said thermosensitive member and a cover member for holding the other surface of said thermosensitive member, wherein said thermosensitive member recurves when it exceeds a critical temperature, and said cover member has an opening which does not hinder said cover member from holding said thermosensitive member, and portions projecting radially inward from said opening. The opening is not limited to a particular configuration and typically formed in a circular or oval shape, depending on the configuration of a thermosensitive member. If a circular opening is adopted, it is preferable that an opening with a diameter larger than that of a thermosensitive member is formed and said projecting portion alone hold the thermosensitive member.

The present invention also comprises an approximately polygonal thermosensitive member, a holder for holding one surface of said thermosensitive member and a cover member for holding the other surface of said thermosensitive member, wherein said thermosensitive member recurves when it exceeds a critical temperature, and said cover member has an opening which does not hinder said cover member from holding said thermosensitive member and holds said polygonal thermosensitive member on all angles or at least one angle.

In this invention, the cover member has the opening with such shape and diameter as not to hinder the cover member from holding said thermosensitive member. This puts the thermosensitive member in direct contact with the air heated by the fixing roller or the like and with the radiant heat emitted from the fixing roller or the like. This keeps its high heat responsiveness. And in this invention, the thermosensitive member is held by portions of the cover member projecting radially inward, and on all or a part of the angles of its approximately polygonal shape. This reduces the loss of heat conductivity from the thermosensitive member to the cover member and also keeps the high heat responsiveness of the former.

In this invention, holding one or the other side of the thermosensitive member means not only holding by putting it in direct contact with the cover member or holder but also holding in such a way as to prevent the thermosensitive member from being apart from the thermostat. When the thermosensitive member is disposed perpendicular downward to the cover member, the two members do not have to be in contact with each other. On the contrary, when the thermostat is made upside down and the thermosensitive member is disposed perpendicular upward to the cover member, the holder and the thermosensitive member do not have to be in contact with each other.

In a preferred arrangement, the surface opposite the cover member of the thermosensitive member is treated to absorb heat. The treatment method is not particularly limited. It is typical to coat the surface with heat-resistant paint superior in heat absorption. Black paint is listed as paint superior in heat absorption. If the thermosensitive member is treated to absorb heat, its heat responsiveness becomes still better. Since most thermostats are actuated at a maximum of about 300° C., it is preferable to adopt heat-resistant paint which does not deteriorate due to heat beyond that degree.

It is preferable that the thickness of paint is less than $30\mu$. Beyond that, a firm paint film hinders the thermosensitive member from recurving. Even worse, when the thermosensitive member recurves repeatedly, a paint film may be stripped off its surface. After many data were analyzed and economical efficiency considered, it was concluded that as for heat-resistant paint, its thickness is preferably about 4 to 6 microns regardless of the kind.

The surface of the thermosensitive member, preferably the whole surface, is exposed through the opening of the cover member. Only the holding portion of the cover member preferably covers the thermosensitive member.

The thermosensitive member may be formed in a round shape or an approximately polygonal shape. If the thermosensitive member is to be formed in an approximately polygonal shape, an approximately rectangular shape is preferable. In this arrangement, the curvature radius of the thermosensitive member in the longitudinal direction is formed longer than that of the latitudinal direction. For example, when a monitored object is in an axial shape, such as a fixing roller, more sufficient heat-absorbing operation can be achieved by making the longitudinal direction of the thermosensitive member parallel to that of the monitored object. In addition, the curvature radius in the latitudinal direction of the thermosensitive member is formed enough to make the pin move and turn on the switch.

As for the cover member of this invention, it is preferable that the portion holding the thermosensitive member projects towards the thermosensitive member. In such arrangement, the air heated by the fixing roller and the like can heat the thermosensitive member more quickly, reaching the reverse side of the thermosensitive member through the non-projecting portion of the cover member. One surface of the thermosensitive member has higher heat expansion rate and the other has the lower rate, and the above arrangement is preferable, especially when the surface with the lower rate faces a monitored object (a fixing roller, etc.).

The holder of this invention has preferably one or more projections which project towards the thermosensitive member, which is held by this projection. While escape of heat absorbed by the thermosensitive member to other members reduces its heat responsiveness to that extent, the above arrangement can improve the heat responsiveness because of a decreased contact area between the thermosensitive member and the cover member. Because the air heated by the fixing roller etc. moves to the reverse side of the thermosensitive member through the non-projecting portion of the holder, it can heat the thermosensitive member more quickly.

In general, the pin which transmits the recurving operation of the thermosensitive member to a contact portion is built in the thermostat, and a through hole which guides the pin is formed in the holder. Preferably through portions are formed radially outside the through hole for the pin. In this arrangement, as heat transmission from the thermosensitive member to the holder is hindered, the heat responsiveness of the thermosensitive member is improved.

Moreover, the heat which escapes from the thermosensitive member by contact with other members is reduced if the other members have poor thermal conductivity. A poor heat-conducting material is preferably elected for the cover member, typically stainless steel.

DETAILED DESCRIPTION OF THE PREFERRED EMBODIMENTS

Figure 1:
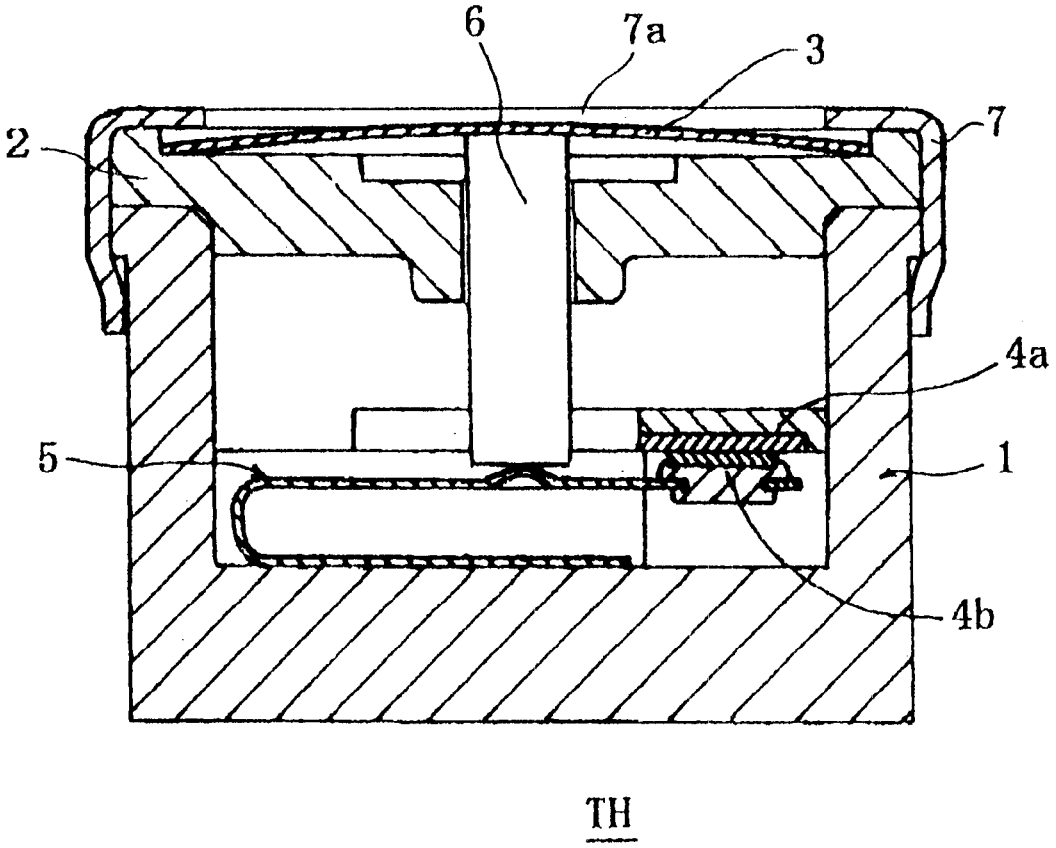
FIG. 1 is a schematic diagram showing configurations of the present thermostat.

FIG. 1 is a schematic diagram showing a whole configuration of the present invention. As shown, a thermostat TH comprises a bottomed cylindrical or bottomed hollow square pillar base 1, a holder 2 to cover the base 1, a bimetal 3 to be held by the outer periphery of the holder 2, contact portions 4 having a fixed contact 4*a* and a movable contact 4*b*, a plate spring 5 for urging the movable contact 4*b* upward, a pin 6 for connecting the bimetal 3 with the plate spring 5 through a central hole of the holder 2, a round or polygonal cover member 7 for covering all the above mentioned members.

The cover member 7 has an opening 7*a* which does not hinder said cover member from holding the bimetal 3. Although the cover member 7 is situated over the bimetal 3 in the drawing, it may be turned upside down the cover member 7 then coming in contact with the bimetal 3. While FIG. 1 is a brief illustration of a basic arrangement, the cover member 7 may have radially inward projecting portions or downward projections on the surface facing the bimetal of the inward projecting portions. Likewise the holder 2 may have upward projections on the surface facing the bimetal or through portions outside a through hole guiding a pin 6.

[Embodiment 1]

The thermostat TH as illustrated in FIG. 1 is located adjacent to, not touching, a columned fixing roller in the illustrated position. In this embodiment, a bimetal 3 is formed in a round shape and evenly coated in a thickness of 10 microns with heat-resistant black paint on the surface (lower expansion rate side) facing a heater, namely, a fixing roller and then dried with heat.

To examine the effect of heat responsiveness of black paint, comparative experiments were conducted with an unpainted bimetal of the same material and configuration.

A cover member 7 is made of aluminum, having a round opening 7*a*. Further experiments were conducted by heating the fixing roller at 200 and 240 volts of alternating current. As for paint, Paint 1 and Paint 2 were used, the nominal heat-resistant temperature of the former being 600° C. and that of the latter 400° C.

As will be obvious from the relations between ① and ② ③ in Table 1, black paints made the maximum temperature fall to 92 to 96% of that of the unpainted bimetal regardless of power voltage. The thermostat cut off electricity by recurving, a little before reaching the maximum temperature. In the case of 240 V, the maximum temperature is higher than that of 200 V because of the faster heating speed of the former. The data of Table 1 reveals that Paint 1, whose nominal heat-resistant temperature is 600° C., is superior to Paint 2.

[Embodiment 2]

In this embodiment, various combinations (Examples 0 to 7) of a cover member 7, a bimetal 3 and a holder 2 were compared in performance. The bimetal is coated black with Paint 1, and a thermostat TH is disposed above a fixing roller, being turned upside down from FIG. 1.

Example 0 is a prior example.

Figure 2:
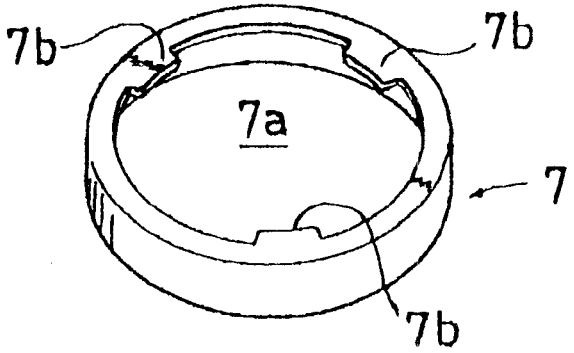
FIG. 2 is a perspective view of an embodiment of the cover member.
Figure 3:
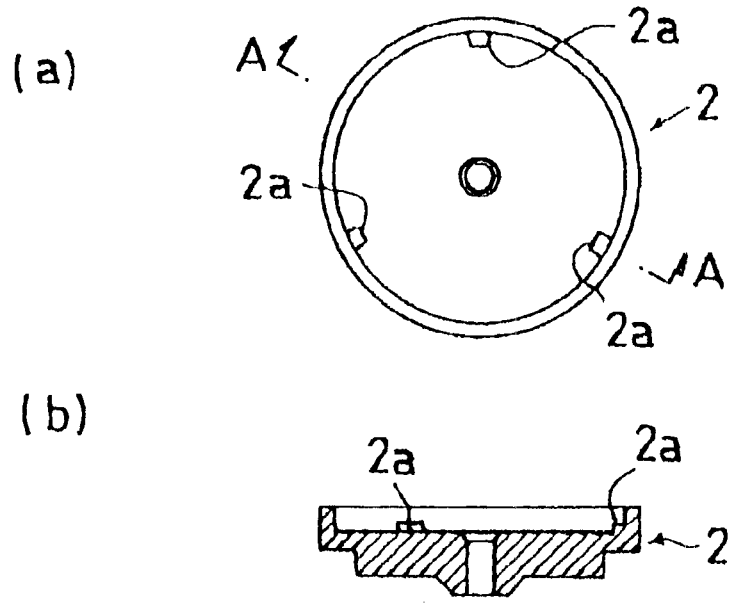
FIG. 3 is a view showing an embodiment of the holder.
Figure 4:
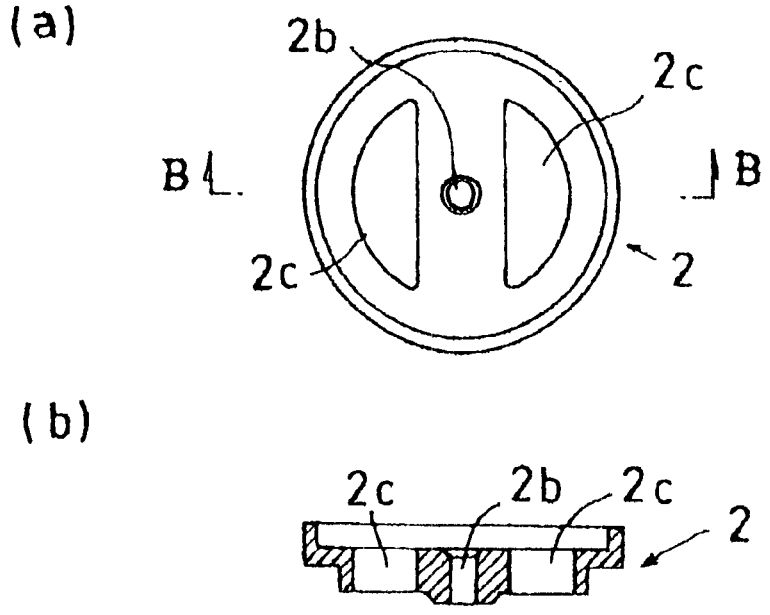
FIG. 4 is a view of another embodiment of the holder.

Example 2 has a cover member 7 wherein a round opening 7*a* whose shape is approximately the same as that of a bimetal 3 is formed and three portions (inward projecting portions 7*b*) projecting radially inward from the opening are formed at intervals of 120° (FIG. 2). These inward projecting portions 7*b* alone hold the bimetal 3. Only the portion of the cover member 7 which holds the bimetal 3 covers the bimetal 3. Example 2 also has projections projecting toward the bimetal 3 on the inward projecting portions 7*b*.

Example 4 has a holder 2 wherein three projections 2*a* projecting toward a bimetal 3 are formed circumferentially at intervals of 120° and hold the bimetal 3. Example 5 has a through hole 2*b* which guides a pin 6 and through portions 2*c* outside the through hole.

Figure 5:
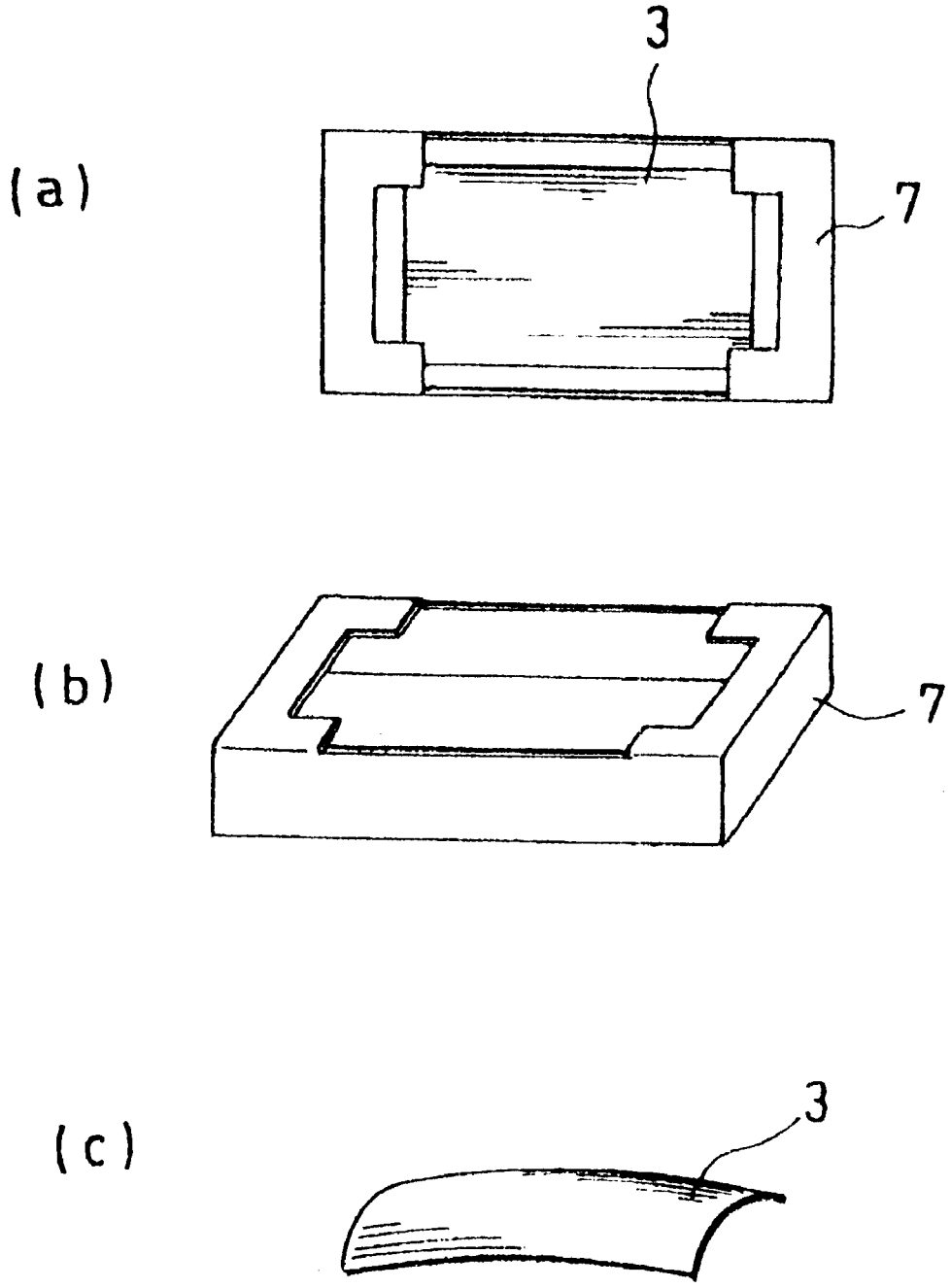
FIG. 5 is a view showing a prismatic cover member and a rectangular bimetal.

Example 6 has an approximately square bimetal 3, whose four angles alone engage a cover member 7. Example 7 has an approximately rectangular bimetal 3 (FIG. 5(*c*)), whose four angles alone engage a cover member 7 (FIG. 5(*a*)). In other words, in both Examples 6 and 7, only the portion of the cover member 7 which holds the bimetal 3 covers the bimetal 3.

In Example 7, the longer side of a bimetal 3 is disposed axially along a fixing roller. Although the shorter side of a bimetal 3 is curved enough for a pin to move, the distance between the bimetal and the fixing roller is almost even along the whole longer side, because the curvature radius in the longer side is sufficiently great.

Table 3 shows the data of Examples 0 to 7.

Table 4 is an enlarged graph of Table 3.

As shown in Table 4, the maximum temperature fell in the order of Example 0, Example 1, Example 5, Example 3, Example 4≈Example 6, Example 2, Example 7. This reveals that Example 7 is the best in heat responsiveness and that a stainless cover member generally achieves high performance.

[Embodiment 3]

As for Examples 3, 4 and 5, an experiment was conducted by disposing a thermostat TH below a fixing roller. The results are shown in Table 5.

Table 6 is an enlarged graph of Table 5.

Table 6 shows that the maximum temperature fell in the order of Example 3, Example 5, and Example 4. Example 4 having projections achieves higher performance than Example 5 having a through portion in a holder 2. The air heated by a fixing roller can presumably heat a bimetal 3 more quickly, moving to the reverse side of a bimetal 3 through the non-projecting portion of the holder 2.

THE EFFECTS OF THE PRESENT INVENTION

As described above, the present invention can provide a thermostat which does not abrade a monitored object, even if movable, and is superior in heat responsiveness.

TABLE 2

| | Cover member | Bimetal | Holder |
|---|---|---|---|
| Example 0 | Aluminium<br>Circular opening | Round<br>No paint | Standard |
| Example 1 | Aluminium<br>Circular opening | Round<br>Black | Standard |
| Example 2 | Aluminium<br>Circular opening<br>Inward projecting portions | Round<br>Black | Standard |
| Example 3 | Stainless steel<br>Circular opening | Round<br>Black | Standard |
| Example 4 | Stainless steel<br>Circular opening | Round<br>Black | w/Three projections |
| Example 5 | Stainless steel<br>Circular opening | Round<br>Black | w/Through portion |
| Example 6 | Stainless steel<br>Circular opening | Approx. square<br>Black | Standard |
| Example 7 | Stainless steel<br>Circular opening | Approx. rectangular<br>Black | Standard |

TABLE 1

Experimental results

| Power voltage 200V | | | | | Power voltage 240V | | | | |
|---|---|---|---|---|---|---|---|---|---|
| Specification | | Example No. | Maximum temperature (° C.) | Average (° C.) | Specification | | Example No. | Maximum temperature (° C.) | Average (° C.) |
| ① | | 1 | 445 | 448.6 | ① | | 1 | 485 | 477.0 |
| Cover | Al | 2 | 450 | | Cover | Al | 2 | 480 | |
| No paint | w/opening | 3 | 443 | | No paint | w/opening | 3 | 470 | |
| | | 4 | 455 | | | | 4 | 475 | |
| | | 5 | 450 | | | | 5 | 475 | |
| ② | | 1 | 417 | 410.4 | ② | | 1 | 445 | 445.0 |
| Cover | Al | 2 | 410 | | Cover | Al | 2 | 445 | |
| Paint 1 | w/opening | 3 | 385 | | Paint 1 | w/opening | 3 | 440 | |
| | | 4 | 420 | | | | 4 | 450 | |
| | | 5 | 420 | | | | 5 | 445 | |
| ③ | | 1 | 425 | 428.6 | ③ | | 1 | 440 | 456.0 |
| Cover | Al | 2 | 430 | | Cover | Al | 2 | 460 | |
| Paint 2 | w/opening | 3 | 415 | | Paint 2 | w/opening | 3 | 450 | |
| | | 4 | 443 | | | | 4 | 470 | |
| | | 5 | 430 | | | | 5 | 460 | |

Specification compared

| | Power voltage 200V (° C.) | | | Power voltage 240V (° C.) | | |
|---|---|---|---|---|---|---|
| Specification | ① | ② | ③ | ① | ② | ③ |
| Maximum temperature | 448.6 | 410.4 | 428.6 | 477.0 | 445.0 | 456.0 |
| Difference from ① | | −38.2 | −20.0 | | −32.0 | −21.0 |

TABLE 3
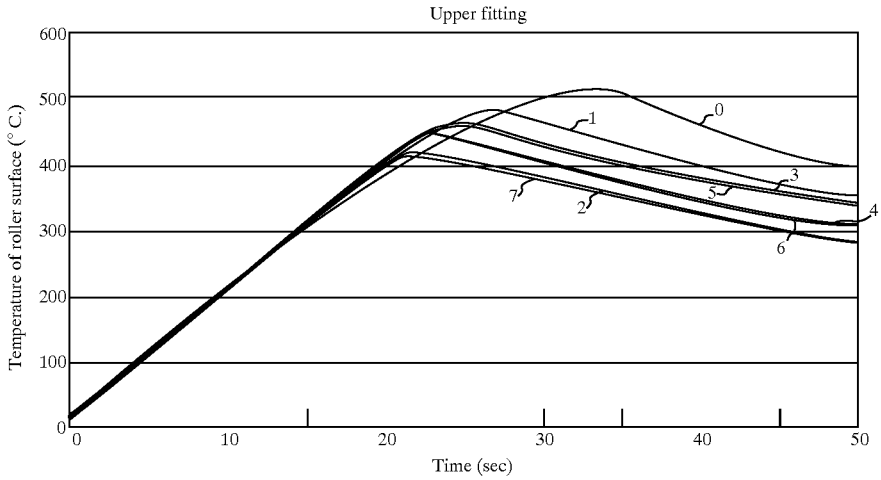
Numerical data
| | Example 0 | Example 1 | Example 2 | Example 3 | Example 4 | Example 5 | Example 6 | Example 7 |
|---|---|---|---|---|---|---|---|---|
| Maximum temperature | 507.7 | 478.6 | 420.2 | 469.0 | 444.8 | 470.7 | 445.9 | 412.4 |
| Diff. from Prior Example | — | −29.1 | −87.5 | −38.7 | −62.9 | −37.0 | −61.8 | −95.3 |
| Diff. from Example 1 | 29.1 | — | −58.4 | −9.6 | −33.8 | −7.9 | −32.7 | −66.2 |
(° C.)
TABLE 4
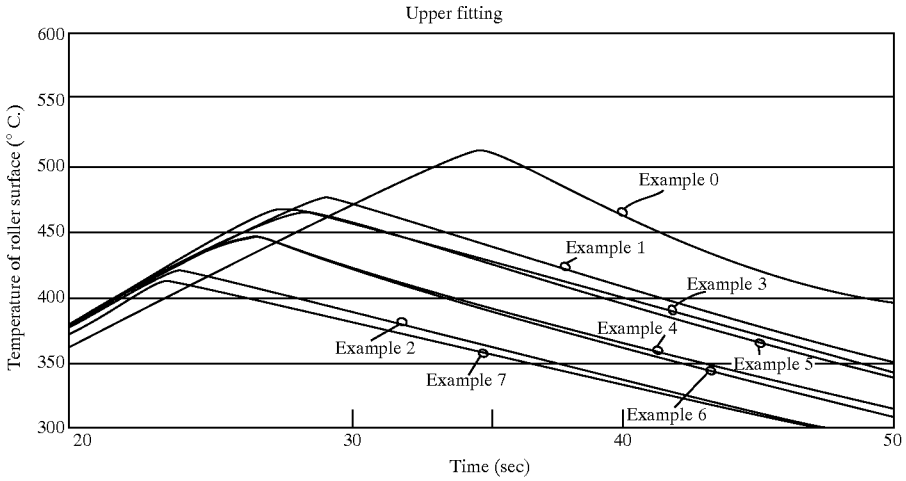

TABLE 5

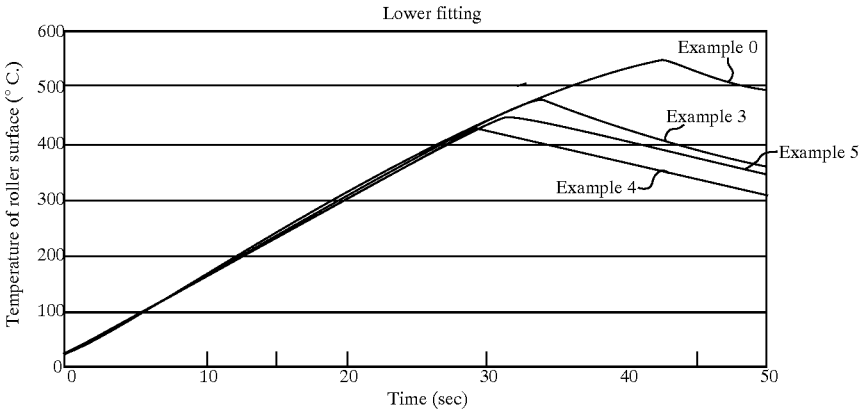

Numerical data

| | Example 0 | Example 3 | Example 4 | Example 5 |
|---|---|---|---|---|
| Maximum temperature | 549.0 | 483.0 | 437.7 | 461.6 |
| Diff. from Example 0 | — | −66.0 | −111.3 | −87.4 |
| Diff. from Example 3 | 66.0 | — | −45.3 | −21.4 |

(° C.)

TABLE 6

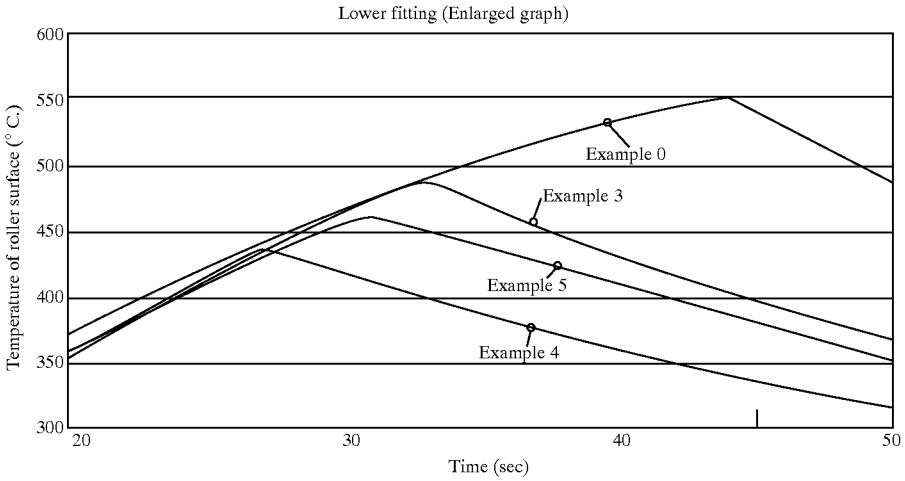

What we claim:

1. A thermostat comprising an approximately round thermosensitive member, a holder for holding one surface of said thermosensitive member and a cover member for holding the other surface of said thermosensitive member, wherein said thermosensitive member recurves when it exceeds a critical temperature;

said cover member has an opening and portions projecting radically inward from said opening which alone hold said thermosensitive member; and the surface of said thermosensitive member which faces said cover member is treated to absorb heat by coating the surface with heat-resistant paint superior in heat absorption.

2. The thermostat as defined in claim 1, wherein at least a part of the portion holding said thermosensitive member of said cover member projects toward said thermosensitive member.

3. The thermostat as defined in claim 1, wherein said holder has at least one projection which projects toward said thermosensitive member, and said thermosensitive member is held by said projection.

4. The thermostat as defined in claim 1, wherein said holder has a through portion outside a through hole which guides a pin.

5. The thermostat as defined in claim 1, wherein said cover member is made of stainless steel.

6. A thermostat comprising an approximately rectangular thermosensitive member, a holder for holding one surface of said thermosensitive member and a cover member for holding the other surface of said thermosensitive member, wherein said thermosensitive member recurves when it exceeds a heat-resistant temperature;

said cover member has an opening which does not hinder said cover member from holding said thermosensitive member, and holds said rectangular thermosensitive member on all angles or at least one angle;

and the surface of said thermosensitive member which faces said cover member is treated to absorb heat by coating the surface with heat-resistant paint superior in heat absorption.

7. The thermostat as defined in claim 6, wherein the curvature radius of said thermosensitive member in the longitudinal direction is sufficiently greater than that in the latitudinal direction.

8. The thermostat as defined in claim 6, wherein said holder has a through portion outside a through hole which guides a pin.

9. The thermostat as defined in claim 6, wherein said cover member is made of stainless steel.

* * * * *